US006786776B2

(12) United States Patent
Itano et al.

(10) Patent No.: US 6,786,776 B2
(45) Date of Patent: Sep. 7, 2004

(54) ELECTRICAL CONNECTOR JACK

(75) Inventors: Michael M. Itano, Seattle, WA (US); William D. Regester, Bothell, WA (US); John M. Redfield, Brier, WA (US)

(73) Assignee: Leviton Manufacturing Co., Inc., Little Neck, NY (US)

( * ) Notice: Subject to any disclaimer, the term of this patent is extended or adjusted under 35 U.S.C. 154(b) by 0 days.

(21) Appl. No.: 10/662,042

(22) Filed: Sep. 12, 2003

(65) Prior Publication Data

US 2004/0127105 A1 Jul. 1, 2004

Related U.S. Application Data

(63) Continuation-in-part of application No. 10/261,165, filed on Sep. 27, 2002, now Pat. No. 6,641,443.

(51) Int. Cl.[7] ..... H01R 24/00
(52) U.S. Cl. ..... 439/676
(58) Field of Search ..... 439/676, 941, 439/76.1, 620

(56) References Cited

U.S. PATENT DOCUMENTS 5,299,956 A 4/1994 Brownell et al.
5,310,363 A 5/1994 Brownell et al.
5,425,658 A 6/1995 White
5,431,584 A 7/1995 Ferry
5,470,244 A 11/1995 Lin et al.
5,513,065 A 4/1996 Caveney et al.
5,586,914 A 12/1996 Foster et al.
6,409,547 B1 6/2002 Reede
6,554,653 B2 * 4/2003 Henneberger ..... 439/676

* cited by examiner

*Primary Examiner*—Gary Paumen
(74) *Attorney, Agent, or Firm*—Davis Wright Tremaine LLP; George C. Rondeau, Jr.

(57) ABSTRACT

A connector jack having a body with a receptacle to receive a plug, a circuit board, and contact tines extending within the receptacle. Each tine has an end attached to the circuit board and a free end, and is moved in response to contact by a corresponding one of the plug contacts in a first direction as the plug is inserted into the receptacle. The jack includes resilient spring members extending within the receptacle, each positioned adjacent to a corresponding one of the tines to be engaged thereby when moved in the direction by the corresponding plug contact as the plug is inserted into the receptacle, and apply a supplemental force to increase contact force and tine resiliency. A tine contact portion has a pair of lateral members that receive a spring engagement portion therebetween and has a recess in which the spring engagement portion is positioned.

33 Claims, 8 Drawing Sheets

ELECTRICAL CONNECTOR JACK

CROSS-REFERENCE TO RELATED APPLICATION

This application is a continuation-in-part of U.S. patent aplication Ser. No. 10/261,165, filed Sep. 27, 2002, now U.S. Pat. No. 6,641,443 currently pending.

BACKGROUND OF THE INVENTION

The Category 6 jack is a receptacle that accepts a Category 6 plug, and is frequently used to electrically interconnect telecommunication equipment. There are several standards that dictate how the Category 6 jack is constructed and performs. Two of which are TIA/EIA 568 B and FCC part 68. The TIA standard is largely a cabling standard to allow for proper installation and performance criteria. The FCC standard is a legal standard that dictates physical characteristics of the plug and jack, such as form factor.

To meet jack performance requirements as dictated by the TIA standard, the tines of the jack must be as short as possible. To provide satisfactory electrical characteristics for the Category 6 jack, it is best that the tines be as short as possible. However, the shorter the tines the less resiliency will be demonstrated by the tines. This can create a problem when mating the Category 6 jack with a non-Category 6 plugs as required by the TIA standard discussed below.

In particular, the TIA standard requires the Category 6 jack be usable with legacy plugs (e.g., 6 position wide-2 contact plates or 6P-2C, 6 position wide-6 contact plates or 6P-6C, and so on). Such use can occur during testing after installation of Category 6 jacks when a test meter having an RJ-11 style plug (6P-4C) is plugged into one of the Category 6 jacks. Also, such use can occur when using a Category 6 jack to receive other style plugs, such as a typical phone plug (6P-2C) used for voice transmissions. When using these legacy plugs with the Category 6 jack, some of the tines of the jack encounter large amounts of deflection. While the tines of a Category 6 jack receiving a Category 6 plug usually experience a relatively small deflection, use of a legacy plug with the Category 6 jack may result in a much larger deflection. This is because the older style plugs do not have cut outs where there would be a recessed conductive plate or opening on an RJ-45 style plug (Category 5, 5e or 6). However, to provide sufficient resiliency of the tines to allow such a large amount of deflection without permanent deformation, the tines must have a length so long that electrical performance is degraded.

The FCC standard specifies that the contact force between the Category 6 jack and plug when mated be a minimum of 100 grams (0.22 pounds). This is largely to ensure good electrical contact between the plug and the jack. If the Category 6 jack has tines long enough to provide the resiliency needed to accommodate legacy plugs without deformation, as discussed above, providing the necessary contact force becomes a problem since increasing the resiliency of the tine tends to cause the tine to generate lower contact force with the plug contact. The increased length also degrades electrical performance.

As such, it is desirable to provide a Category 6 jack with tines as short as possible to improve electrical performance of the jack, while still providing the resiliency to accommodate legacy plugs and the contact force needed to meet the TIA and FCC standards.

FIELD OF THE INVENTION

This invention relates to an electrical connector, and in particular, to a jack used for telecommunication equipment.

BRIEF SUMMARY OF THE INVENTION

The present invention is embodied in a connector jack usable with a plug having a plurality of plug contacts. The jack includes a body having a receptacle sized and configured to receive the plug therein, a plurality of contact tines, each having a contact portion within the receptacle positioned to be engaged by a correspondingly positioned one of the plug contacts when the plug is inserted into the receptacle, and a plurality of resilient spring members. Each of the spring members is configured to apply a reaction force to one of the contact tines when engaged by the correspondingly positioned plug contact in a direction to generate a supplemental contact force between the contact tine and the correspondingly positioned plug contact.

In the illustrated embodiment, the contact tines each having a first side and an opposite second side, with the first side of each contact tine having a contact portion within the receptacle positioned to be engaged by the correspondingly positioned one of the plug contacts when the plug is inserted into the receptacle. Each spring member is positioned adjacent to the second side of a correspondingly positioned one of the contact tines. The spring members each have at least a portion positioned within the receptacle and adjacent to the second side of the correspondingly positioned one of the contact tines.

In the illustrated embodiment, each spring member is configured to apply a force against the corresponding contact tine when in a deflected position sufficient to at least assist in moving the corresponding contact tine to a return position when the plug is removed from the receptacle.

The tine contact portion of each contact tine has a tine contact first portion and a tine contact second portion, and the spring member has a spring engagement portion. The tine contact first portion is positioned for contact by the corresponding one of the plug contacts when the plug is inserted into the receptacle and the tine contact second portion is positioned for engagement with the spring engagement portion. The tine contact second portion includes a pair of lateral members spaced apart sufficiently to receive and retain therebetween the spring engagement portion to limit lateral movement thereof when the tine contact second portion is in engagement with the spring engagement portion.

The tine contact second portion is elongated and the lateral members extend longitudinally along at least a portion of the tine contact second portion and define a laterally limited, longitudinally extending space therebetween. The space is substantially unobstructed to permit sliding movement of the spring engagement portion through the space as the contact tine is moved.

The tine contact second portion further has a recess sized to capture the spring engagement portion to restrict lateral movement of the spring engagement portion. The tine contact second portion of each tine has a bend therein at least in part forming the recess. The lateral members also at least in part form the recess. The spring engagement portion is a rounded, free end portion of the spring member.

Other features and advantages of the invention will become apparent from the following detailed description, taken in conjunction with the accompanying drawings.

DETAILED DESCRIPTION OF THE INVENTION

Figure 1:
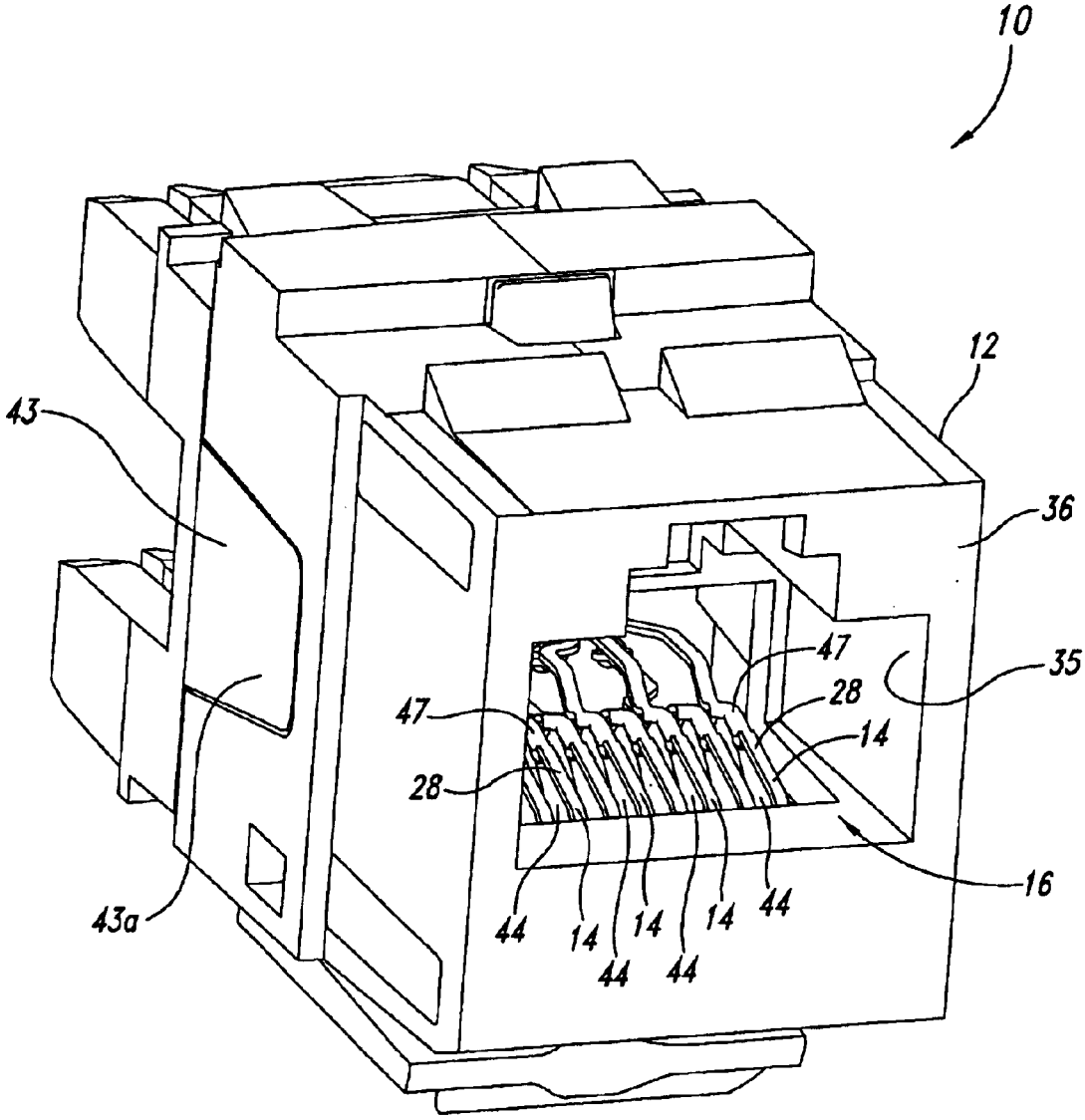
FIG. 1 is an isometric view of an electrical connector jack embodying the present invention.

An embodiment of a Category 6 RJ series electrical connector jack 10 of the present invention is illustrated in FIG. 1 fully assembled and ready for use. The jack 10 includes a dielectric housing or body 12 and a plurality of resilient contact tines 14 in parallel arrangement within an interior receptacle 16 of the body. The tines 14 may be spring wires with round or other cross-sectional shapes, elongated contact plates or have other suitable contact tine constructions. In the illustrated embodiment, eight tines 14 are used, but a fewer or greater number may be used as desired for the style connector while utilizing the principals of the invention. The body 12 is typically formed of plastic, and the tines 14 are formed of a conventional phosphor bronze metal used for Category 6 jacks and other style jacks. The receptacle 16 is sized and configured to receive a Category 6 plug 18 of conventional design, shown in cross-section in FIG. 4 inserted into the receptacle. The plug 18 has a plurality of metal conductive plates or contacts 20 which when the plug is inserted into the receptacle 16 are in contact with corresponding ones of the tines 14. The plug 18 generally has two to eight contacts 20. As noted above, other style plugs may be inserted into the receptacle 16 and those plugs may have a variety of different numbers of contacts.

Figure 2:
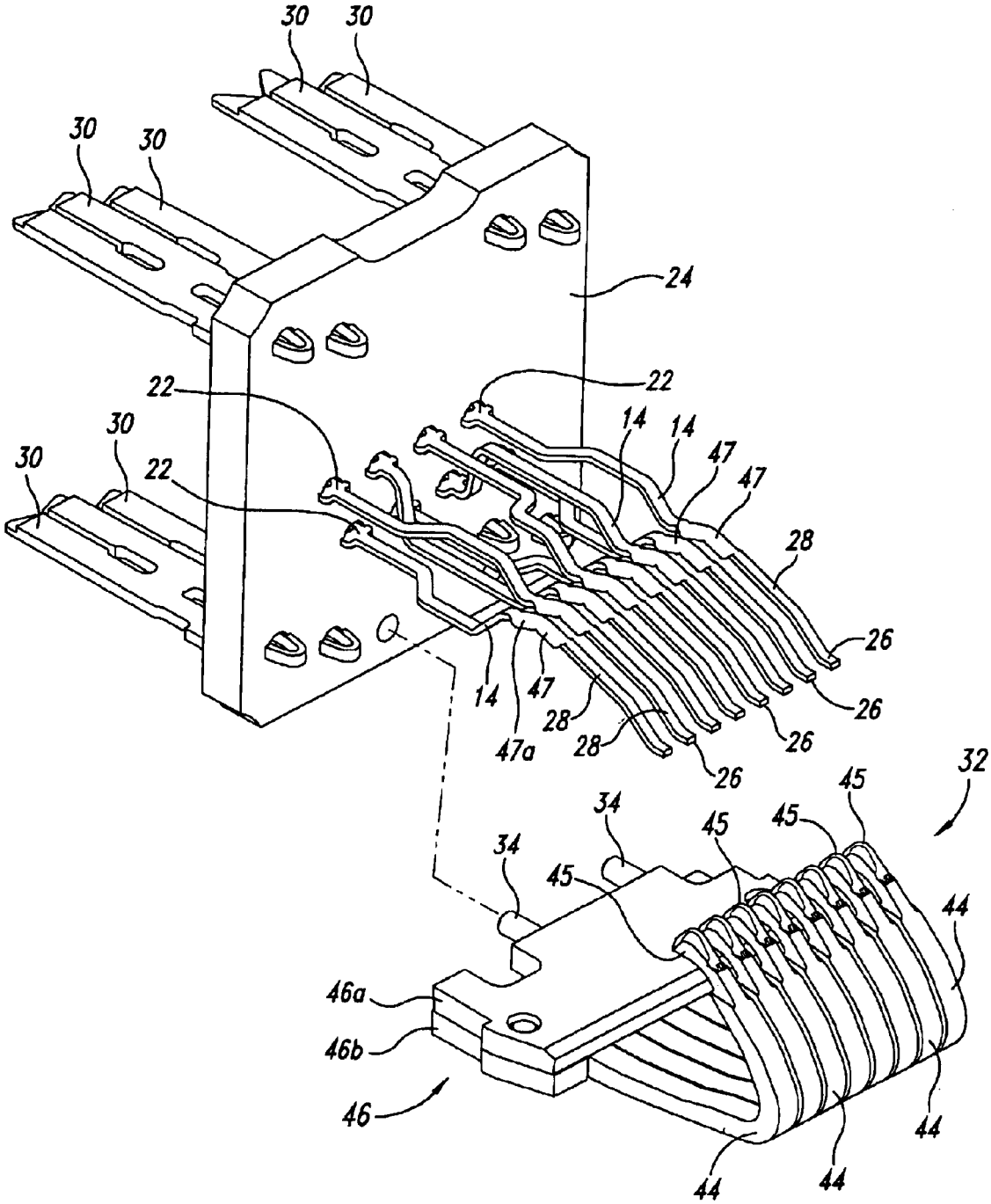
FIG. 2 is an exploded isometric view of the electrical connector jack shown in FIG. 1 with the spring assembly separated from the circuit board and without the connector body or the terminal block.
Figure 3:
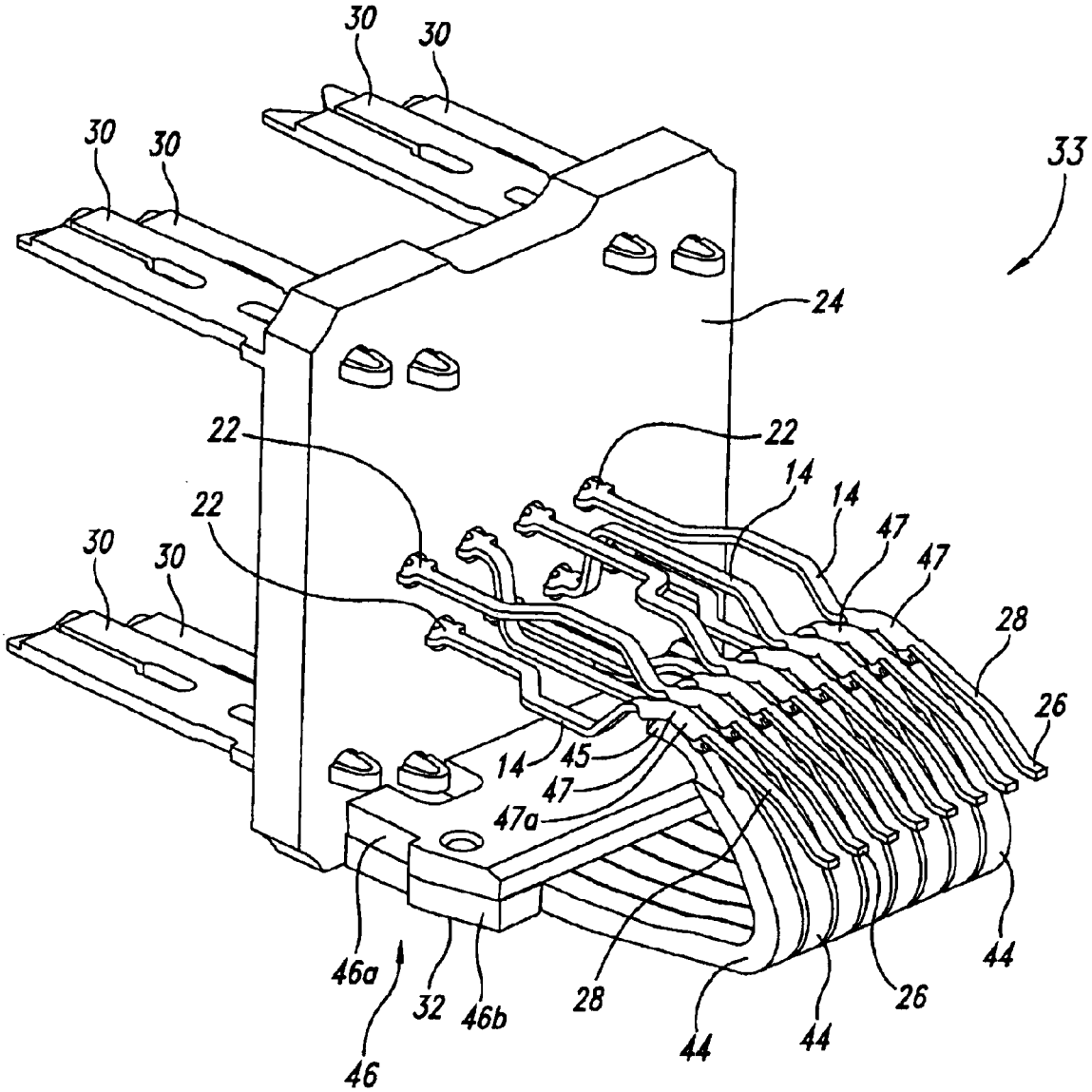
FIG. 3 is an isometric view of the electrical connector jack assembly shown in FIG. 2 with the spring assembly shown mounted to the circuit board but still without the connector body and the terminal block.

As shown in FIGS. 2 and 3, the tines 14 each have a first end portion 22 fixedly attached to a printed circuit board 24 and have a second free end portion 26. Each tine 14 has a first contact portion 28 extending between its first and second end portions 22 and 26. As will be discussed below, the first contact portions 28 are arranged in the body 12 to be contacted by the contacts 20 of the plug 18 when inserted into the receptacle 16. The first contact portions 28 of the tines 14 are in a generally parallel arrangement and the tines are essentially allowed to "float" as simple cantilevered beams. The printed circuit board 24 also supports eight insulation displacement contacts (IDCs) 30, each being electrically connected through the circuit paths on the printed circuit board to one of the eight tines 14. Wires carrying electrical signals may be connected to the IDCs 30 in a conventional manner. Other style contacts and means may be used to electrically connect signals to the tines 14. In the illustrated embodiment of the connector jack 10, the IDCs 30 are pressed into place in apertures in the printed circuit board 24, and the first end portions 22 of the tines 14 are first pressed into place in apertures in the printed circuit board and then soldered.

Figure 4:
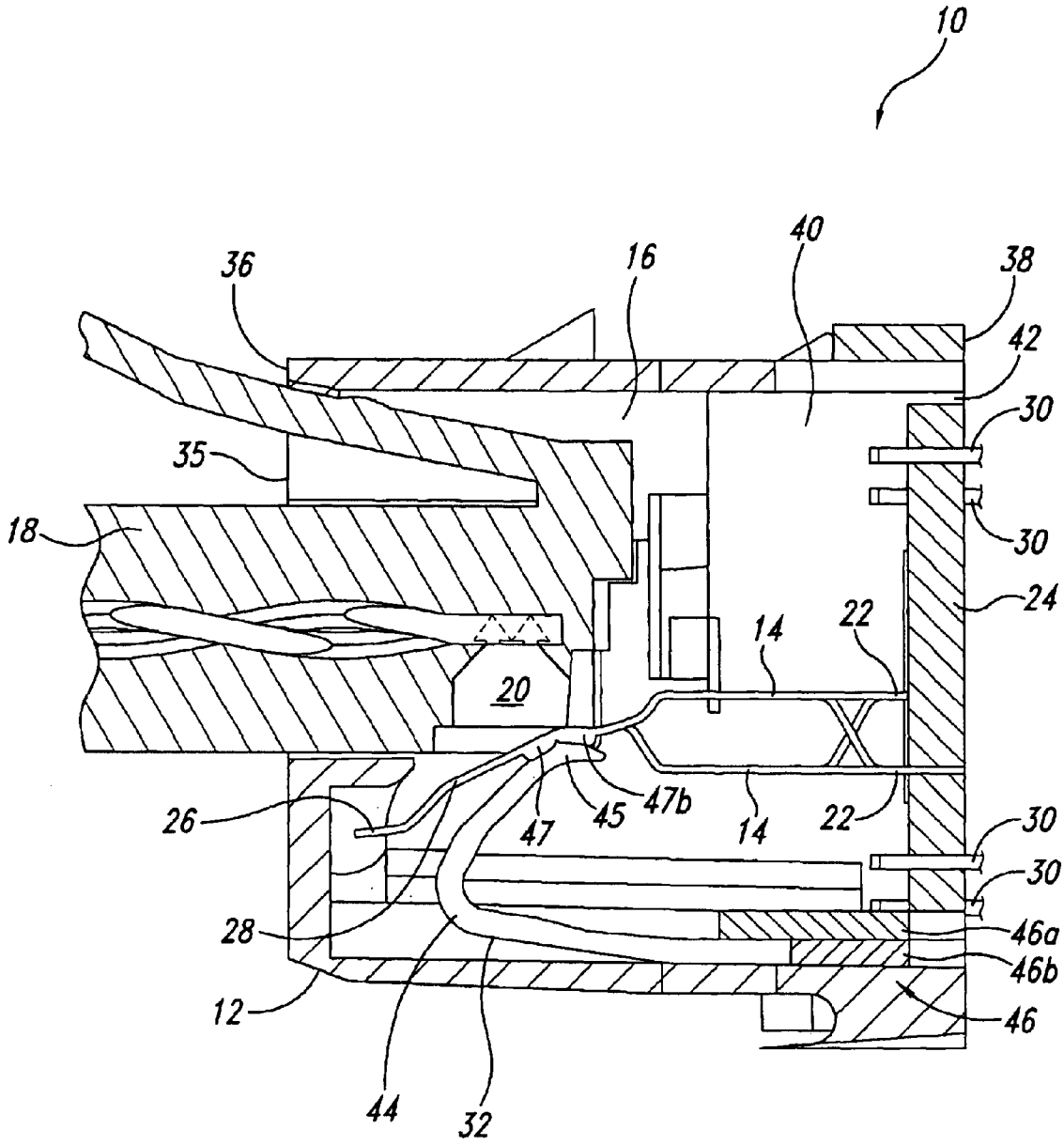
FIG. 4 is a cross-sectional view of the electrical connector jack shown in FIG. 1 without the terminal block.

When the printed circuit board 24 has the tines 14 and the IDCs 30 attached, a spring assembly 32 is mounted to the printed circuit board 24 in position below the tines as shown in FIG. 3. As best seen in FIG. 2, the spring assembly 32 has a pair of protrusions 34 which are inserted into apertures in the printed circuit board. The printed circuit board assembly, indicated by reference numeral 33, is shown in FIG. 3 ready for positioning within the body 12 of the connector jack 10, as is illustrated in FIG. 4.

The receptacle 16 of the body 12 has a forward facing opening 35 in a forward end 36 of the body 12 which is sized to pass the plug 18 therethrough as it is inserted into the receptacle. As shown in FIG. 4, a rearward end 38 of the body 12 has a chamber 40 with a rearward facing opening 42 sized to receive the assembled printed circuit board 24 therein. The printed circuit board 24 is positioned adjacent to the receptacle 16 with the tines 14 projecting forward into the receptacle in position for the first contact portions 28 thereof to be contacted by the contacts 20 of the plug 18 when inserted into the receptacle to make electrical contact therewith. A carrier or terminal block 43, shown in FIG. 1, is mounted at and covers the rearward facing opening 42 of the chamber 40, and captures and holds the printed circuit board 24 in place. Snaps securely connect the terminal block 43 to the body 12. The terminal block 43 has apertures to allow access to the IDCs 30 which project rearward from the printed circuit board 24 to allow connection of wires thereto.

The tines 14 are laterally spaced apart so that one tine is contacted by a correspondingly positioned one of the plug contacts 20 when the plug 18 is inserted into the receptacle 16. The contact of the plug contacts 20 with the tines 14 moves the contacted tines in a generally downward direction, with a small rearward component, as the tines flex downward in response thereto. Each of the tines 14 is sufficiently resilient to produce a first generally upward force on the tine against the corresponding plug contact 20 in response thereto. This serves as a contact force between the tine and the plug contact to help provide good electrical contact. However, as discussed above, it is desirable to keep the tines 14 as short as possible to improve electrical performance of the jack, while still providing sufficient resiliency to accommodate legacy plugs and the contact force needed to meet the FCC standards. To do so, the spring assembly 32 is positioned below the tines 14, as best seen in FIG. 4, to provide increased contact force and resiliency than the tines alone can produce in response to the tines moving downward as the plug 18 is inserted into the receptacle 16, without requiring the tines to be longer than desired to provide good electrical performance. The increased resiliency allows the insertion of legacy plugs into the receptacle 16 and the resulting extreme flexure of the tines 14 that can result, without permanent deformation of the tines.

The spring assembly 32 includes eight resilient, non-conductive spring arms 44, each positioned immediately under a correspondingly positioned one of the tines 14. A head portion 45 of each spring arm 44 is in contact with an underside of a second contact portion 47 of the tine opposite the side of the tine contacted by the plug contact 20. The second contact portion 47 is forward of the first end portion 22 of the tine 14 and rearward of the first contact portion 28, and located at a downward bend in the tine. The spring arms 44 extend forward from a spring assembly base 46, with a slight upward slant, and have a knee bend whereat the spring arms project generally upward and rearward and terminate in a free end portion including the head portion 45. Each of the spring arms 44 is positioned to have the head portion 45 thereof engaged by and move downward with the correspondingly positioned tine 14 as the tine moves downward when the plug 18 is inserted into the receptacle 16. The spring arm head portion 45 moves downward with a small rearward component since the tine deflects with an arcuate movement.

The spring arms are 44 laterally separated from each other by a small distance. As such, each of the spring arms 44 is independently movable relative to the other ones of the spring arms, and each spring arm provides a second generally upward force on the correspondingly positioned tine which is transmitted to the plug contact 20 contacting the tine. This creates a supplemental upward force that causes an increased contact force between the tine and the plug contact (generally the sum of the first and second upward forces). The supplemental upward force also causes the tine to respond as if having greater resiliency than experienced by the unassisted tine, and assists the return movement of the tine when the plug 18 is removed from the receptacle 16 and allowed to return from its deflected position to its original position before the plug was inserted into the receptacle. This improvement in mechanical performance is accomplished without the need to lengthen and thicken the tines 14 to achieve it and thereby degrade electrical performance of the Jack. Also, since each spring arm 44 operates on the tine 14 it engages independent of the other spring arms, the same characteristics of increased contact force and tine resiliency are experienced by a tine whether one tine or all eight tines are being engaged by plug contacts 20. This provides consistent performance characteristics for the jack 10.

The increased tine resiliency improves the ability of the jack 10 to handle legacy plugs having substantially different sizes and styles than a Category 6 plug, when inserted into the receptacle 16 by allowing an increased range of elastic deflection without undesirable permanent deformation of the tines 14. The independent operation of the spring arms 44 allows the use of legacy plugs of many configurations, size and number of plug contacts that cause some tines 14 to deflect by large amounts such as when engaged by sidewalls or other non-contact portions of the plug, while other tines do not and still producing good electrical contact with the contacts of the legacy plug and without damage to the tines. Again, the increased resiliency is accomplished without the need to lengthen and thicken the tines to achieve it.

Rails inside the body 12 align and hold the spring arms 44 in position for contact with the plug contacts 20. The body also includes features to capture the tines 14.

The spring assembly 32 is manufactured of a non-conductive plastic, thus the spring arms 44 can directly contact the metal tines without requiring insulation or causing an electrical problem. The plastic is selected to provide a good life cycle with low creep or cold flow characteristics.

Figure 5:
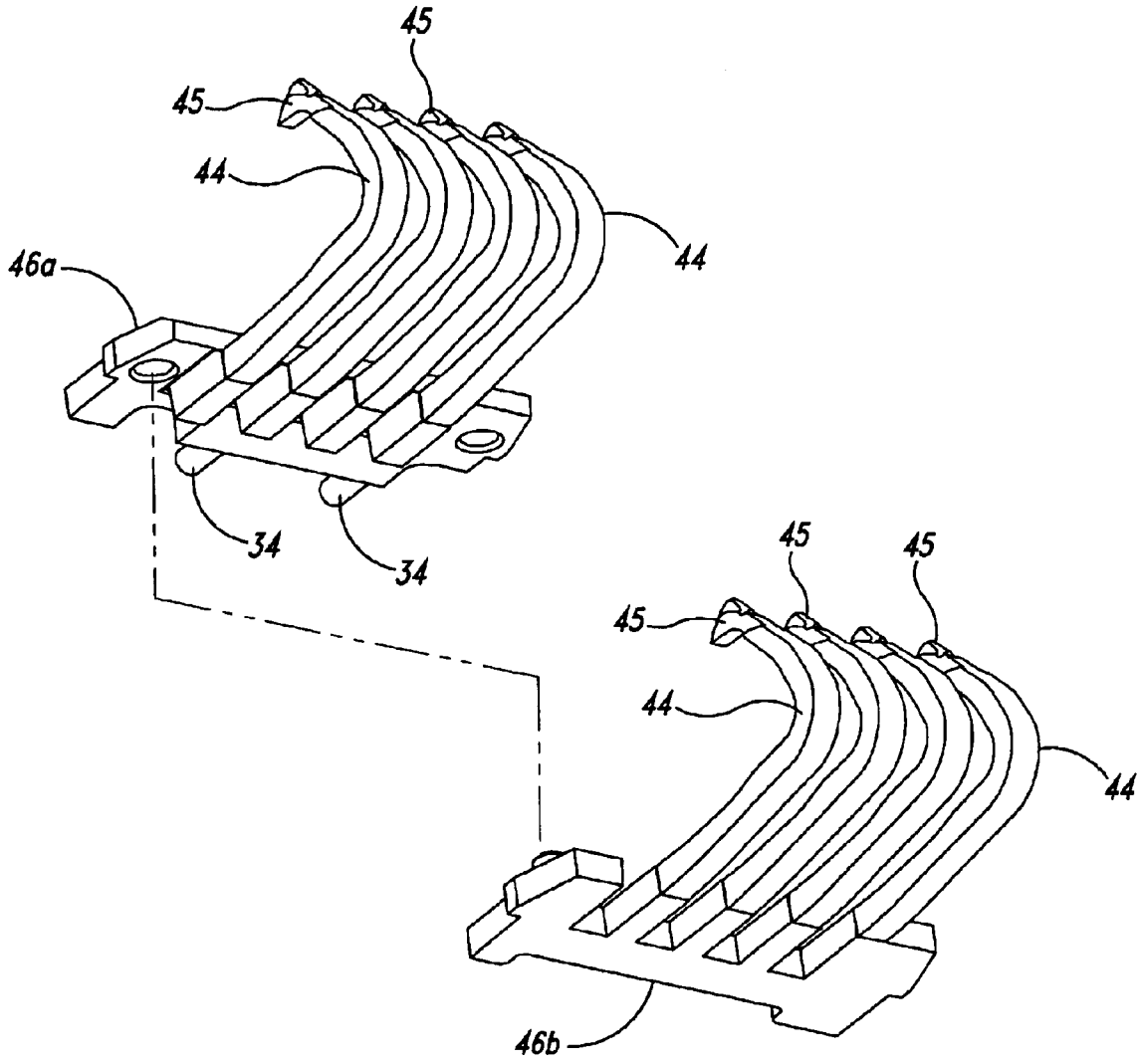
FIG. 5 is an exploded isometric view of the two separated components of the spring assembly used with the electrical connector jack shown in FIG. 1.

As best seen in FIGS. 2, 3 and 5, the spring assembly 32 is composed of two separately molded components for ease of manufacture. In particular, the first component includes a first portion 46*a* of the base 46 which has the pair of protrusions 34 which secure the spring assembly 32 to the printed circuit board 24, and has every other one of the eight spring arms 44 projecting therefrom. The second component includes a second portion 46*b* of the base 46, and has the other four of the eight spring arms 44 projecting therefrom. Adjacent spring arms of the first component are separated by slightly greater than the width of one of the spring arms of the second component, and adjacent spring arms of the second component are separated by slightly greater than the width of one of the spring arms of the first component. As such, when the first and second components of the spring assembly 32 are assembled together, with the spring arms of the first and second assemblies interleaved, there is a very small space between neighboring spring arms of the first and second assemblies which allows their independent movement.

An alternative method of achieving such closely spaced spring arms would be to injection mold the spring assembly 32 as one piece, but put thin blades of steel between each spring arm position in the mold cavity. This would cause the resulting eight spring arms to be closely spaced but yet independently movable.

Figure 6:
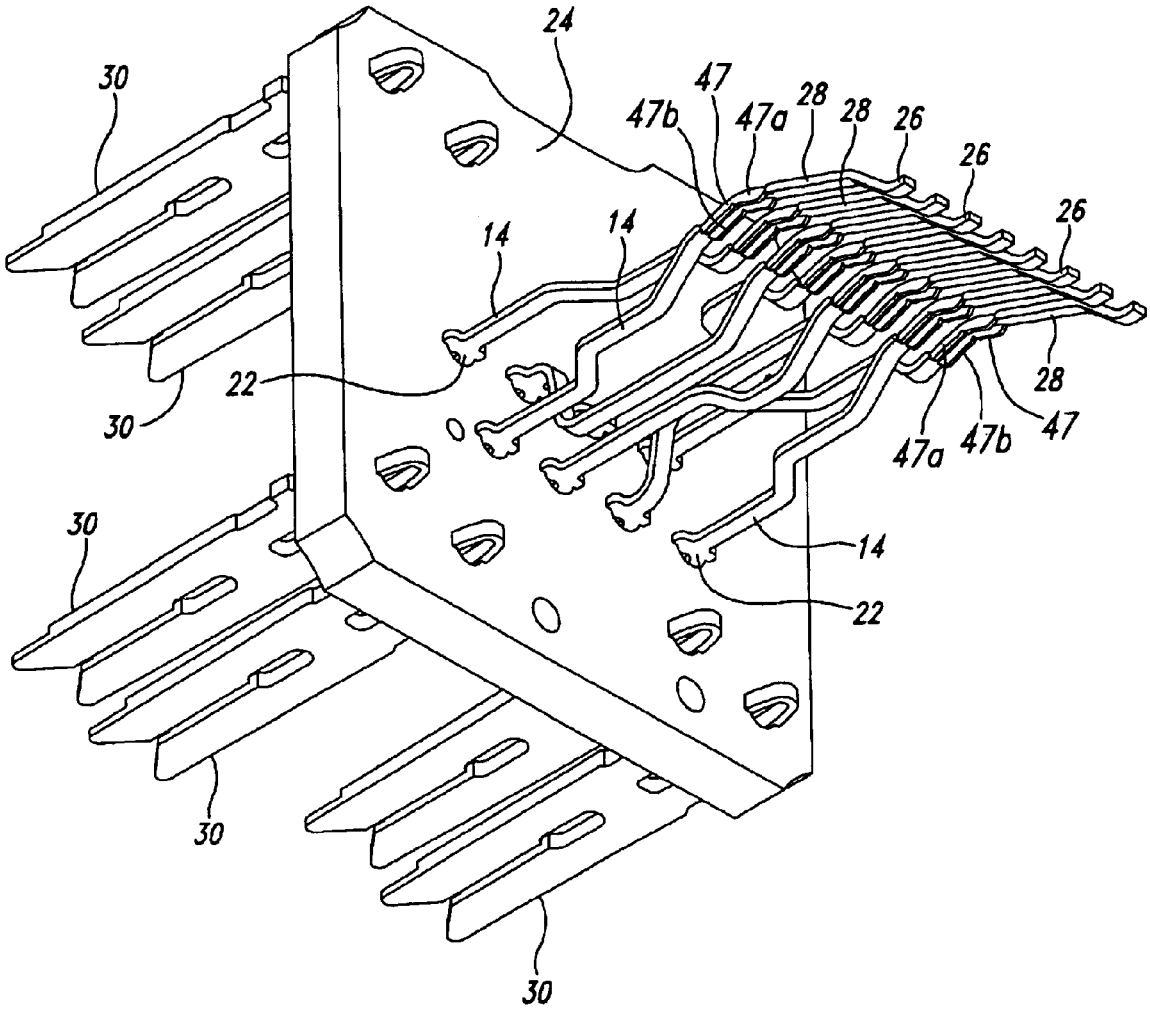
FIG. 6 is a bottom isometric view of the electrical connector jack assembly shown in FIG. 2 without the spring assembly, the connector body or the terminal block.
Figure 7:
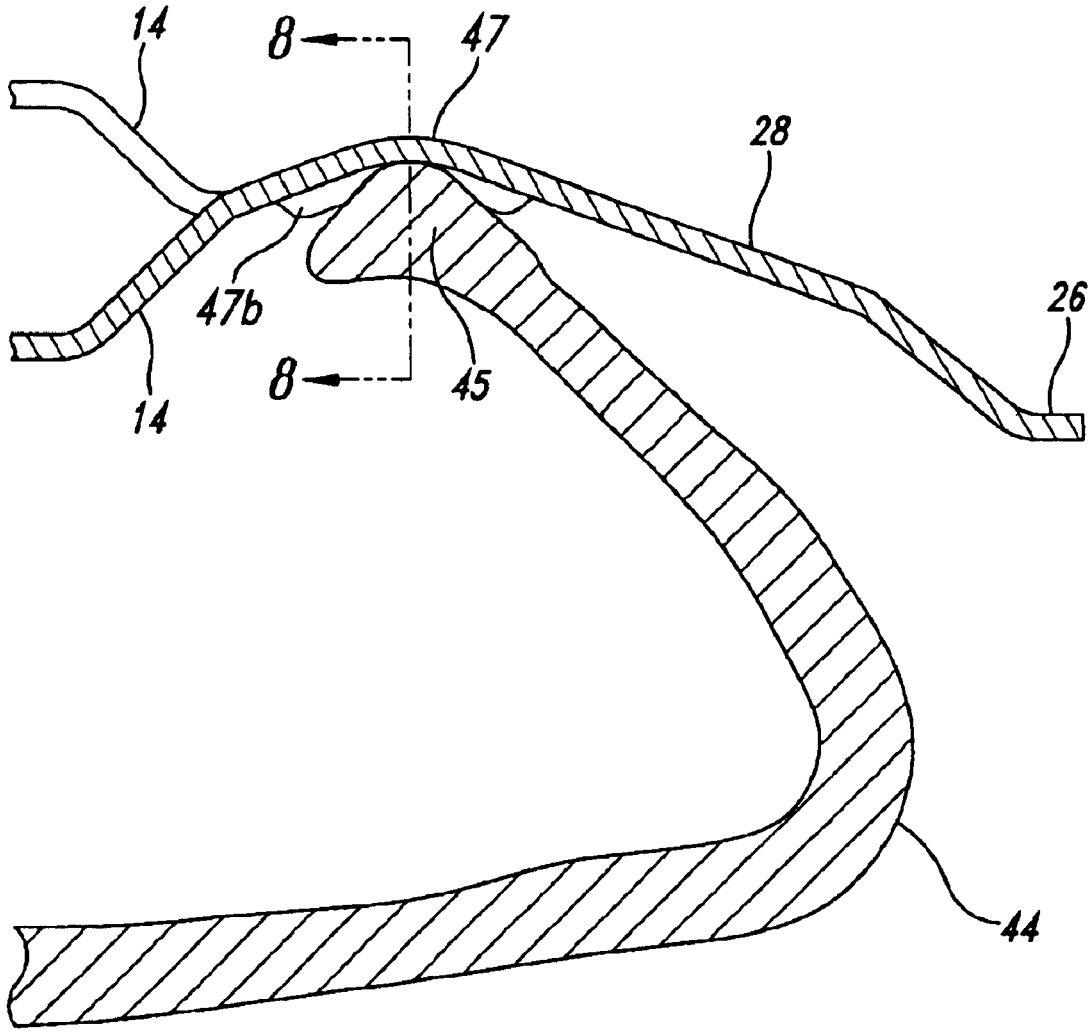
FIG. 7 is an enlarged, fragmentary, side cross-sectional view of one tine and spring arm pair of the electrical connector jack assembly shown in FIG. 3 shown in positive engagement.
Figure 8:
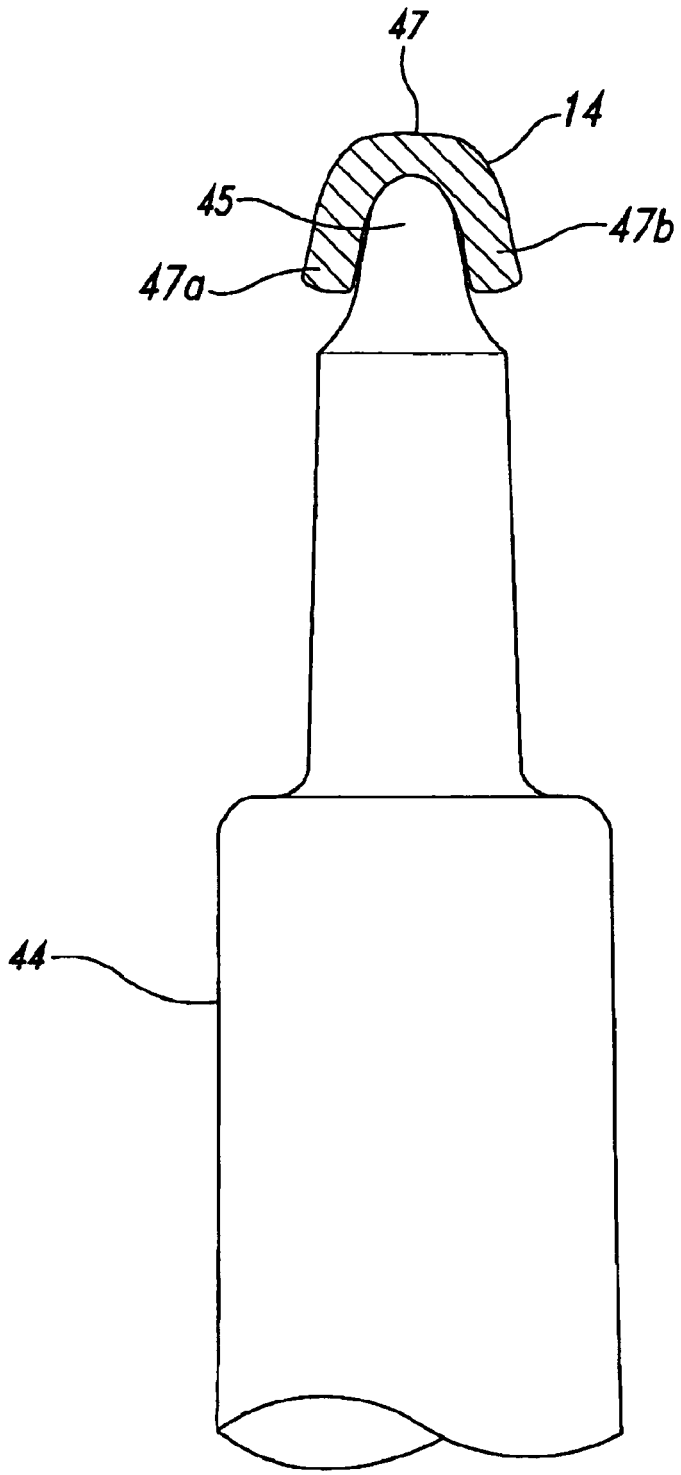
FIG. 8 is an enlarged, fragmentary, end view of one tine shown in cross-section in positive engagement with the correspondingly positioned spring arm of the electrical connector jack assembly of FIG. 3.

As best seen in FIGS. 6, 7 and 8, the second contact portion 47 of each of the tines 14 has downwardly projecting left and right side skirts 47*a* and 47*b*, respectively, each having forward and rearward portions with a small notch therebetween at about the peak of a downward bend in the tine. The second contact portion 47 thus forms an inverted, longitudinally extending cupped trough of the tine 14. The head portion 45 of the spring arm 44 has a rounded contact portion in contact with the underside of the second contact portion 47 of the tine 14 in the trough area thereof between the left and right side skirts 47*a* and 47*b* which essentially trap or capture the head portion of the spring arm between the left and right side skirts against lateral movement relative to the tine engaged.

The left and right side skirts 47*a* and 47*b* of the second contact portion 47 of the tine 14 extend in a forward-rearward direction and hence allow sliding movement of the head portion 45 of the spring arm 44 therebetween relative to the tine in the forward and rearward directions as the tine flexes and moves up and down during insertion and removal of the plug 18 or a legacy plug into or from the receptacle 16. While some forward-rearward sliding of the head portion 45 relative to the tine 14 does occur, because of the second contact portion 47 is located at the downward bend of the tine 14, the second contact portion 47 and head portion 45 form somewhat of a cup and ball socket with the head portion of the spring arm 44 captured in a recess or pocket defined by the deepest portion of the cupped trough of the second contact portion of the tine at about the peak of the bend in the tine.

This arrangement essentially positions the head portion 45 at the free end of the spring arm 44 in a longitudinally extending groove of the tine 14 to restrain lateral movement of the spring arm head portion while allowing some longitudinal movement; however, the bend of the tine causes the head portion to nest in the deepest portion of the cupped trough which tends to retain the head portion therein and cause the head portion to move with a rolling or rotational movement in response to most forward-rearward forces on the spring arm. If the forward-rearward force on the spring arm 44 is sufficiently large to dislodge the head portion 45 from the deepest portion of the cupped tough, the head portion can longitudinally slide along the trough between the left and right side skirts restrained against lateral movement relative to the tine. This arrangement provides a more positive engagement of the spring arm and the tine.

While the present invention is illustrated and discussed with respect to a Category 6 jack, it should be understood that the invention is useful for many style jacks, including but not limited to Category 3, Category 5, Category 5e and other telecommunication and non-telecommunication jacks, and that the jacks need not utilize a printed circuit board mounting for the tines 14, spring assembly 32 or other components or utilize a printed circuit board at all.

From the foregoing it will be appreciated that, although specific embodiments of the invention have been described herein for purposes of illustration, various modifications may be made without deviating from the spirit and scope of the invention. Accordingly, the invention is not limited except as by the appended claims.

We claim:

1. A connector jack, usable with a plug having a plurality of plug contacts, the jack comprising:

a body having a receptacle sized and configured to receive the plug therein;

a circuit board positioned adjacent to the receptacle;

a plurality of contact tines, each having a first end fixedly attached to the circuit board, a second free end and a contact portion between the first and second ends, the tine contact portions being positioned within the receptacle to be contacted by a corresponding one of the plug contacts and moved in response thereto in a first direction as the plug is inserted into the receptacle, each tine being sufficiently resilient to produce a first force on the tine contact portion against the corresponding plug contact in response to having been moved in the first direction, the tine contact portion of each tine having a tine contact first portion and a tine contact second portion, the tine contact first portion being positioned for contact by the corresponding one of the plug contacts when the plug is inserted into the receptacle; and a plurality of resilient, non-conductive elongated spring arms, each having an independently movable spring member portion within the receptacle positioned adjacent to a corresponding one of the tine contact portions to be engaged by the corresponding tine contact portion when moved in the first direction by the corresponding plug contact as the plug is inserted into the receptacle, each spring arm being configured for the spring member portion thereof to apply a second force on the corresponding tine contact portion against the corresponding plug contact in response to having been moved in the first direction to produce a contact force between the corresponding tine contact portion and plug contact substantially equal to the sum of the first and second forces and to assist return movement of the corresponding tine contact portion in a second direction opposite the first direction when the plug is removed from the receptacle, the spring member portion of each spring arm having a spring engagement portion, the tine contact second portion being positioned for engagement with the spring engagement portion, the tine contact second portion including a pair of lateral members spaced apart sufficiently to receive and retain therebetween the spring engagement portion to limit lateral movement thereof when the tine contact second portion is in engagement with the spring engagement portion.

2. The connector jack of claim 1 wherein the tine contact second portion is elongated and the lateral members extend longitudinally along at least a portion of the tine contact second portion and define a laterally limited, longitudinally extending space therebetween, the space between the lateral members being substantially unobstructed to permit sliding movement of the spring engagement portion through the space as the tine is moved.

3. The connector jack of claim 1 wherein the tine contact first portion is positioned between the first and second ends of the tine, and the tine contact second portion is positioned between the tine contact first portion and the first end of the tine.

4. The connector jack of claim 1 wherein the spring engagement member portion is a free end portion of the spring arm.

5. A connector jack, usable with a plug having a plurality of plug contacts, the jack comprising:

a body having a receptacle sized and configured to receive the plug therein;

a circuit board positioned adjacent to the receptacle;

a plurality of contact tines, each having a first end fixedly attached to the circuit board, a second free end and a contact portion between the first and second ends, the tine contact portions being positioned within the receptacle to be contacted by a corresponding one of the plug contacts and moved in response thereto in a first direction as the plug is inserted into the receptacle, each tine being sufficiently resilient to produce a first force on the tine contact portion against the corresponding plug contact in response to having been moved in the first direction, the tine contact portion of each tine having a tine contact first portion and a tine contact second portion, the tine contact first portion being positioned for contact by the corresponding one of the plug contacts when the plug is inserted into the receptacle; and a plurality of resilient, non-conductive elongated spring arms, each having an independently movable spring member portion within the receptacle positioned adjacent to a corresponding one of the tine contact portions to be engaged by the corresponding tine contact portion when moved in the first direction by the corresponding plug contact as the plug is inserted into the receptacle, each spring arm being configured for the spring member portion thereof to apply a second force on the corresponding tine contact portion against the corresponding plug contact in response to having been moved in the first direction to produce a contact force between the corresponding tine contact portion and plug contact substantially equal to the sum of the first and second forces and to assist return movement of the corresponding tine contact portion in a second direction opposite the first direction when the plug is removed from the receptacle, the spring member portion of each spring arm having a spring engagement portion, the tine contact second portion being positioned for engagement with the spring engagement portion, the tine contact second portion having a recess sized to capture the spring engagement portion to restrict lateral movement of the spring engagement portion.

6. The connector jack of claim 5 wherein the tine contact second portion of each tine has a bend therein at least in part forming the recess.

7. The connector jack of claim 6 wherein the tine contact second portion includes a pair of lateral members spaced apart sufficiently to receive and retain therebetween the spring engagement portion to limit lateral movement thereof when the tine contact second portion is in engagement with the spring engagement portion, the lateral members at least in part forming the recess.

8. The connector jack of claim 7 wherein the tine contact second portion is elongated and the lateral members extend longitudinally along at least a portion of the tine contact second portion and define a laterally limited, longitudinally extending space therebetween, the space between the lateral members being substantially unobstructed to permit sliding movement of the spring engagement portion through the space as the tine contact is moved.

9. The connector jack of claim 5 wherein the spring engagement member portion is a free end portion of the spring arm.

10. The connector jack of claim 5 wherein the spring engagement member portion is a rounded, free end portion of the spring arm.

11. A connector jack, usable with a plug having a plurality of plug contacts, the jack comprising:

a body having a receptacle sized and configured to receive the plug therein;

a plurality of contact tines extending within the receptacle with each in position for contact by a corresponding one of the plug contacts and movement in response thereto from a first position to a second position when the plug is in the receptacle, each contact tine having a tine contact first portion and a tine contact second portion, the tine contact first portion being positioned for contact by the corresponding one of the plug contacts when the plug is in the receptacle; and a plurality of resilient spring members extending within the receptacle and positioned adjacent to a corresponding one of the contact tines to be engaged by the corresponding contact tine when moved from the first position to the second position by the corresponding plug contact when the plug is in the receptacle, each spring member being configured to apply a force against the corresponding contact tine in a direction from the second position toward the first position to produce a contact force between the corresponding contact tine and plug contact when the plug is in the receptacle, each spring member having a spring engagement portion, the tine contact second portion being positioned for engagement with the spring engagement portion, the tine contact second portion including a pair of lateral members spaced apart sufficiently to receive and retain therebetween the spring engagement portion to limit lateral movement thereof when the tine contact second portion is in engagement with the spring engagement portion.

12. The connector jack of claim 11 wherein the tine contact second portion is elongated and the lateral members extend longitudinally along at least a portion of the tine contact second portion and define a laterally limited, longitudinally extending space therebetween, the space between the lateral members being substantially unobstructed to permit sliding movement of the spring engagement portion through the space as the contact tine is moved.

13. The connector jack of claim 11 wherein the contact tine has a first end and a free second end, the tine contact first portion being positioned between first and second ends of the contact tine, and the tine contact second portion being positioned between the tine contact first portion and the first end of the contact tine.

14. The connector jack of claim 11 wherein the spring engagement member portion is a free end portion of the spring member.

15. A connector jack, usable with a plug having a plurality of plug contacts, the jack comprising:

a body having a receptacle sized and configured to receive the plug therein;

a plurality of contact tines extending within the receptacle with each in position for contact by a corresponding one of the plug contacts and movement in response thereto from a first position to a second position when the plug is in the receptacle, each contact tine having a tine contact first portion and a tine contact second portion, the tine contact first portion being positioned for contact by the corresponding one of the plug contacts when the plug is in the receptacle; and a plurality of resilient spring members extending within the receptacle and positioned adjacent to a corresponding one of the contact tines to be engaged by the corresponding contact tine when moved from the first position to the second position by the corresponding plug contact when the plug is in the receptacle, each spring member being configured to apply a force against the corresponding contact tine in a direction from the second position toward the first position to produce a contact force between the corresponding contact tine and plug contact when the plug is in the receptacle, each spring member having a spring engagement portion, the tine contact second portion being positioned for engagement with the spring engagement portion, the tine contact second portion having a recess sized to capture the spring engagement portion to restrict lateral movement of the spring engagement portion.

16. The connector jack of claim 15 wherein the tine contact second portion of each contact tine has a bend therein at least in part forming the recess.

17. The connector jack of claim 16 wherein the tine contact second portion includes a pair of lateral members spaced apart sufficiently to receive and retain therebetween the spring engagement portion to limit lateral movement thereof when the tine contact second portion is in engagement with the spring engagement portion, the lateral members at least in part forming the recess.

18. The connector jack of claim 17 wherein the tine contact second portion is elongated and the lateral members extend longitudinally along at least a portion of the tine contact second portion and define a laterally limited, longitudinally extending space therebetween, the space between the lateral members being substantially unobstructed to permit sliding movement of the spring engagement portion through the space as the contact tine is moved.

19. The connector jack of claim 15 wherein the spring engagement member portion is a free end portion of the spring member.

20. The connector jack of claim 15 wherein the spring engagement member portion is a rounded, free end portion of the spring member.

21. The connector jack of claim 15 wherein each of the contact tines has a first end supported by a support member, a second free end and a contact portion between the first and second ends positioned to be contacted by a corresponding one of the plug contacts.

22. The connector jack of claim 15 wherein each spring member is configured to apply the force against the corresponding contact tine when the corresponding contact tine is in the second position in a sufficient amount to at least assist in moving the corresponding contact tine to the first position when the plug is removed from the receptacle.

23. A connector jack, usable with a plug having a plurality of plug contacts, the jack comprising:

a body having a receptacle sized and configured to receive the plug therein;

a plurality of contact tines, each having a contact portion within the receptacle positioned to be engaged by a correspondingly positioned ones of the plug contacts when the plug is inserted into the receptacle, the tine contact portion of each contact tine having a tine contact first portion and a tine contact second portion, the tine contact first portion being positioned for contact by the corresponding one of the plug contacts when the plug is inserted into the receptacle; and a plurality of resilient spring members, each configured to apply a reaction force to one of the contact tines when engaged by the correspondingly positioned plug contact in a direction to generate a supplemental contact force between the contact tine and the correspondingly positioned plug contact, each spring member having a spring engagement portion, the tine contact second portion being positioned for engagement with the spring engagement portion, the tine contact second portion including a pair of lateral members spaced apart sufficiently to receive and retain therebetween the spring engagement portion to limit lateral movement thereof when the tine contact second portion is in engagement with the spring engagement portion.

24. The connector jack of claim 23 wherein the tine contact second portion is elongated and the lateral members extend longitudinally along at least a portion of the tine contact second portion and define a laterally limited, longitudinally extending space therebetween, the space between the lateral members being substantially unobstructed to permit sliding movement of the spring engagement portion through the space as the contact tine is moved.

25. The connector jack of claim 23 wherein the contact tine has a first end and a free second end, the tine contact first portion being positioned between first and second ends of the contact tine, and the tine contact second portion being positioned between the tine contact first portion and the first end of the contact tine.

26. The connector jack of claim 23 wherein the spring engagement member portion is a free end portion of the spring member.

27. A connector jack, usable with a plug having a plurality of plug contacts, the jack comprising:

a body having a receptacle sized and configured to receive the plug therein;

a plurality of contact tines, each having a contact portion within the receptacle positioned to be engaged by a correspondingly positioned ones of the plug contacts when the plug is inserted into the receptacle, the tine contact portion of each contact tine having a tine contact first portion and a tine contact second portion, the tine contact first portion being positioned for contact by the corresponding one of the plug contacts when the plug is inserted into the receptacle; and a plurality of resilient spring members, each configured to apply a reaction force to one of the contact tines when engaged by the correspondingly positioned plug contact in a direction to generate a supplemental contact force between the contact tine and the correspondingly positioned plug contact, each spring member having a spring engagement portion, the tine contact second portion being positioned for engagement with the spring engagement portion, the tine contact second portion having a recess sized to capture the spring engagement portion to restrict lateral movement of the spring engagement portion.

28. The connector jack of claim 27 wherein the tine contact second portion of each contact tine has a bend therein at least in part forming the recess.

29. The connector jack of claim 28 wherein the tine contact second portion includes a pair of lateral members spaced apart sufficiently to receive and retain therebetween the spring engagement portion to limit lateral movement thereof when the tine contact second portion is in engagement with the spring engagement portion, the lateral members at least in part forming the recess.

30. The connector jack of claim 29 wherein the tine contact second portion is elongated and the lateral members extend longitudinally along at least a portion of the tine contact second portion and define a laterally limited, longitudinally extending space therebetween, the space between the lateral members being substantially unobstructed to permit sliding movement of the spring engagement portion through the space as the contact tine is moved.

31. The connector jack of claim 27 wherein the spring engagement member portion is a free end portion of the spring member.

32. The connector jack of claim 27 wherein the spring engagement member portion is a rounded, free end portion of the spring member.

33. The connector jack of claim 27 wherein each of the contact tines has a first end supported by a support member and a second free end with the contact portion located between the first and second ends in a position to be engaged by the correspondingly positioned one of the plug contacts when the plug is inserted into the receptacle.

* * * * *